US009271555B1

(12) United States Patent
Chen

(10) Patent No.: US 9,271,555 B1
(45) Date of Patent: Mar. 1, 2016

(54) COMPOSITE COSMETIC CONTAINER

(71) Applicant: Sin-Hsiung Chen, Tainan (TW)

(72) Inventor: Sin-Hsiung Chen, Tainan (TW)

( * ) Notice: Subject to any disclaimer, the term of this patent is extended or adjusted under 35 U.S.C. 154(b) by 0 days.

(21) Appl. No.: 14/540,188

(22) Filed: Nov. 13, 2014

(51) Int. Cl.

| | |
|---|---|
| ***A45D 40/24*** | (2006.01) |
| ***A45D 40/02*** | (2006.01) |
| *A45D 40/26* | (2006.01) |
| *A45D 34/00* | (2006.01) |
| *A45D 40/20* | (2006.01) |
| *A45D 40/06* | (2006.01) |
| *A45D 40/04* | (2006.01) |

(52) U.S. Cl.
CPC ..... *A45D 40/24* (2013.01); *A45D 40/02* (2013.01); *A45D 34/00* (2013.01); *A45D 40/04* (2013.01); *A45D 40/06* (2013.01); *A45D 40/205* (2013.01); *A45D 40/264* (2013.01)

(58) Field of Classification Search
CPC ... A45D 40/24; A45D 40/264; A45D 40/205; A45D 40/02; A45D 40/06; A45D 40/04; A45D 4/08; A45D 2040/0025; A45D 40/0068; A45D 2040/204; A45D 34/00; A45D 34/043; A45D 34/06; B65D 83/00
See application file for complete search history.

(56) References Cited

U.S. PATENT DOCUMENTS

| | | | | | |
|---|---|---|---|---|---|
| 1,623,509 | A * | 4/1927 | Vivaudou | A45D 40/24 | 132/318 |
| 2,766,876 | A * | 10/1956 | Hopgood | A45D 40/24 | 401/30 |
| 2,825,085 | A * | 3/1958 | Ingraham | A47L 23/28 | 132/286 |
| 6,039,483 | A * | 3/2000 | Szekely | A45D 40/04 | 222/390 |
| 6,726,016 | B2 * | 4/2004 | Chen | B05B 11/0037 | 206/581 |
| 6,895,628 | B1 * | 5/2005 | Anderson | A45D 40/12 | 132/313 |
| 7,806,614 | B2 * | 10/2010 | Desson | A45D 40/02 | 401/179 |
| 2015/0305475 | A1 * | 10/2015 | Girod | A45D 40/24 | 401/31 |

FOREIGN PATENT DOCUMENTS

| | | |
|---|---|---|
| JP | H01115421 U | 8/1989 |
| JP | H01153119 U | 10/1989 |
| JP | H01175721 U | 12/1989 |

* cited by examiner

*Primary Examiner* — Robyn Doan
(74) *Attorney, Agent, or Firm* — Huffman Law Group, PC

(57) ABSTRACT

A composite cosmetic container has a first sleeve, a driving assembly, multiple vessels and a second sleeve. The driving assembly is mounted in the first sleeve and has a first rotating tube, multiple seats and a second rotating tube. The first rotating tube is coactively mounted in the first sleeve. The vessels are respectively mounted in the seats of the driving assembly. The second sleeve is coactively mounted on the second rotating tube of the driving assembly. The composite cosmetic container facilitates easy control of the vessels to selectively move upward and downward by the relative rotation between the first sleeve and the second sleeve. Multiple cosmetic products are respectively contained in the vessels and are easy to dispense. Accordingly, the options of the cosmetic products contained in the container are increased.

12 Claims, 12 Drawing Sheets

COMPOSITE COSMETIC CONTAINER

BACKGROUND OF THE INVENTION

1. Field of the Invention

The present invention relates to a container, and more particularly to a composite cosmetic container that is capable of containing multiple cosmetic products and is easy to operate.

2. Description of Related Art

A conventional cosmetic container has a first rotating tube, a second rotating tube, a seat and a vessel. The first rotating tube has an inner surface and two longitudinal grooves formed in the inner surface of the first rotating tube. The second rotating tube is rotatably mounted around the first rotating tube. The second rotating tube has an outer surface and two guide chutes formed through the outer surface of the second rotating tube. The seat has a body and two protrusions. The protrusions are mounted on an outer surface of the body. The protrusions are inserted into the longitudinal grooves and the guide chutes respectively. The vessel is mounted on the body. The vessel has a chamber and an outlet. The chamber is formed in the vessel to contain a cosmetic product. The outlet is formed in the vessel and is in communication with the chamber.

Users can rotate the first rotating tube, and then the first rotating tube is rotated with the second rotating tube. The protrusions of the seat are moved along the longitudinal grooves of the first rotating tube and the guide chutes of the second rotating tube, and then the seat drives the vessel to move upward or downward. When the vessel moves upward, the outlet of the vessel extends out, and the cosmetic product in the body can be dispensed easily.

The relative rotation between the first rotating tube and the second rotating tube can only drive a single vessel to move upward or downward, and the vessel only contains one cosmetic product. Therefore, the cosmetic container is not versatile in use.

To overcome the shortcomings, the present invention tends to provide a composite cosmetic container to mitigate or obviate the aforementioned problems.

SUMMARY OF THE INVENTION

The main objective of the invention is to provide a composite cosmetic container that is capable of containing multiple cosmetic products.

The composite cosmetic container has a first sleeve, a driving assembly, multiple vessels and a second sleeve. The driving assembly is mounted in the first sleeve and has a first rotating tube, multiple seats and a second rotating tube. The first rotating tube is coactively mounted in the first sleeve and has an outer surface, an inner surface, an annular flange and multiple chutes. The annular flange is formed around the outer surface of the first rotating tube. The chutes are formed through the outer surface of the first rotating tube. The seats are moveably mounted in the first rotating tube. Each seat has an outer surface, a connecting surface, a guide element, a longitudinal track and multiple protrusions. The outer surface of the seat faces the inner surface of the first rotating tube. The connecting surface faces the connecting surface of another seat. The guide element is formed on the outer surface of the seat and protrudes into a corresponding one of the chutes of the first rotating tube. The longitudinal track is mounted on the connecting surface of the seat. The protrusions are formed on the connecting surface of the seat and protrude into the longitudinal track of another seat. The second rotating tube is rotatably mounted around the first rotating tube. The second rotating tube has an inner surface, an annular groove, multiple longitudinal grooves and a plate. The annular groove is formed in the inner surface and connected to the annular flange of the first rotating tube. The longitudinal grooves are formed in the inner surface of the second rotating tube and the guide elements of the seats respectively protrude into the longitudinal grooves. The plate is integrally formed in the inner surface of the second rotating tube and is located above the longitudinal grooves.

The vessels are respectively mounted in the seats of the driving assembly, and each vessel has a body, a chamber, a pressing head and a cap. The body is mounted in a corresponding one of the seats of the driving assembly. The pressing head is mounted on the body. The cap is mounted on the pressing head and has an outlet, and the cap is located above the plate.

The second sleeve is coactively mounted on the second rotating tube of the driving assembly.

The composite cosmetic container has multiple vessels to contain multiple cosmetic products. Therefore, multiple cosmetic products contained in the composite cosmetic container are available as increased options for the user to select for use. Besides, the first sleeve and the first rotating tube are rotated by the user to control the vessels to selectively move upward and selectively protrude out of the second sleeve. Thus, it is convenient to dispense the cosmetic products from the composite cosmetic container. Furthermore, the first sleeve and the first rotating tube are rotated by the user to control the vessels to selectively move downward, and the outlets of the vessels are selectively retracted in the second sleeve. So the composite cosmetic container provides easy control of the vessels to selectively move upward and downward by the relative rotation between the first sleeve and the second sleeve.

Other objects, advantages and novel features of the invention will become more apparent from the following detailed description when taken in conjunction with the accompanying drawings.

DETAILED DESCRIPTION OF PREFERRED EMBODIMENT

Figure 1:
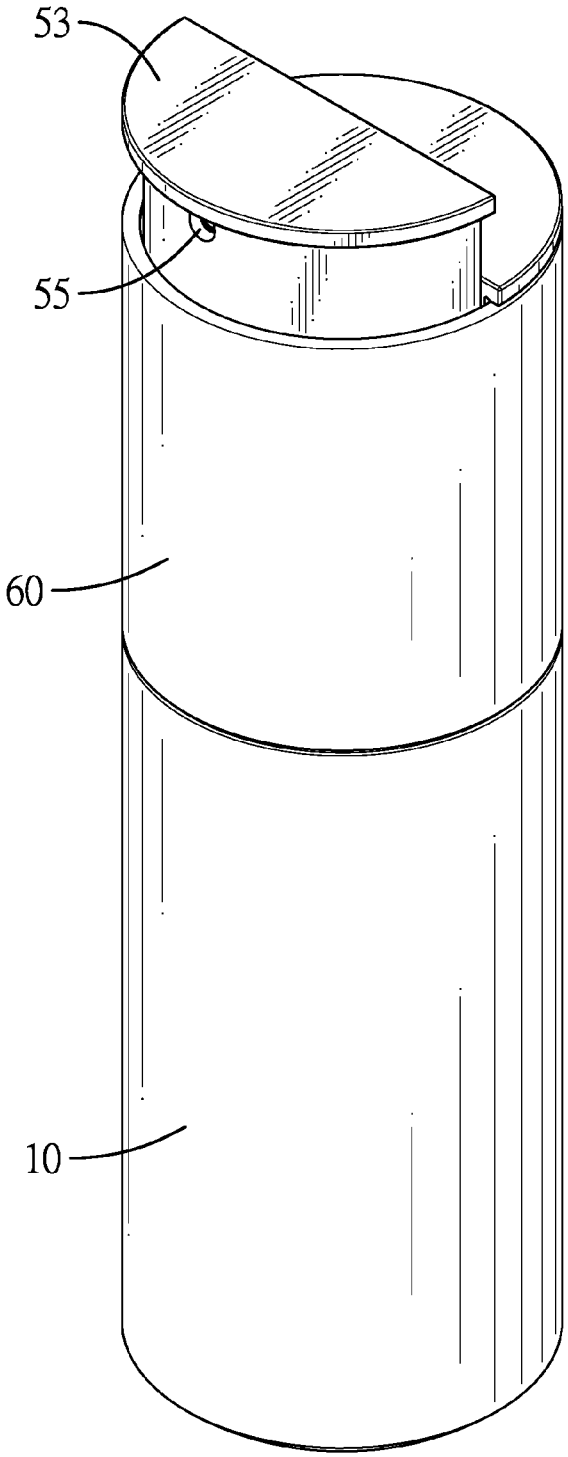
FIG. 1 is a perspective view of a first embodiment of a composite cosmetic container in accordance with the present invention.

With reference to FIGS. 1, 2, 11 and 12, a composite cosmetic container in accordance with the present invention comprises a first sleeve 10, a driving assembly 1, multiple vessels 50 and a second sleeve 60.

The first sleeve 10 has a space and an opening The space is formed in the first sleeve 10. The opening is formed in a top of the first sleeve 10 and is in communication with the space.

The driving assembly 1 is mounted in the first sleeve 10 and has a first rotating tube 20, multiple seats and a second rotating tube 40. The first rotating tube 20 is coactively mounted in the first sleeve 10 and is located in the space of the first sleeve 10. The first rotating tube 20 has an outer surface, an inner surface, an annular flange 21 and multiple chutes. The annular flange 21 is formed around the outer surface of the first rotating tube 20. The chutes are formed through the outer surface of the first rotating tube 20.

Figure 2:
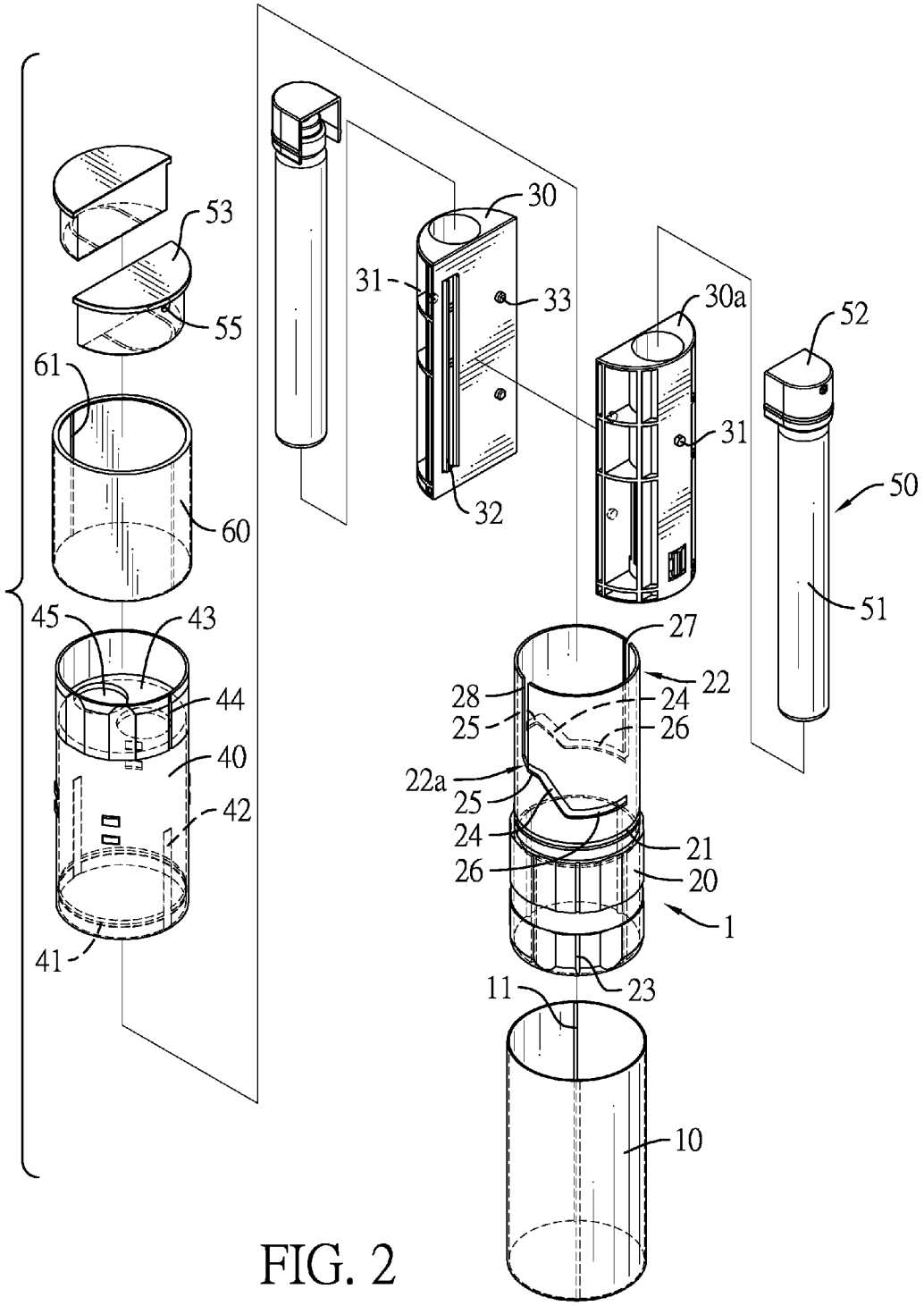
FIG. 2 is an exploded perspective view of the composite cosmetic container in FIG. 1.

The seats are moveably mounted in the first rotating tube 20, and each seat has an outer surface, a connecting surface, a guide element 31, a longitudinal track 32 and multiple protrusions 33. The outer surface of the seat faces the inner surface of the first rotating tube 20. The connecting surface of the seat faces the connecting surface of another seat. The guide element 31 is formed on the outer surface of the seat and protrudes into a corresponding one of the chutes of the first rotating tube 20. The longitudinal track 32 is mounted on the connecting surface of the seat. The protrusions 33 are formed on the connecting surface of the seat and protrude into the longitudinal track 32 of another seat. The second rotating tube 40 is rotatably mounted around the first rotating tube 20, and has an inner surface, an annular groove 41, multiple longitudinal grooves 42 and a plate 43. The annular groove 41 is formed in the inner surface of the second rotating tube 40 and is connected to the annular flange 21 of the first rotating tube 20. The longitudinal grooves 42 are formed in the inner surface of the second rotating tube 40, and the guide elements 31 of the seats respectively protrude into the longitudinal grooves 42. The plate 43 is integrally formed in the inner surface of the second rotating tube 40 and is located above the longitudinal grooves 42. With reference to FIG. 2, each seat has a chamber and a top hole. The chamber is formed in the seat. The top hole is formed in a top of the seat and is in communication with the chamber. The second rotating tube 40 has multiple through holes 45 formed through the plate 43, and the through holes 45 face the top holes of the seats respectively.

Figure 4:
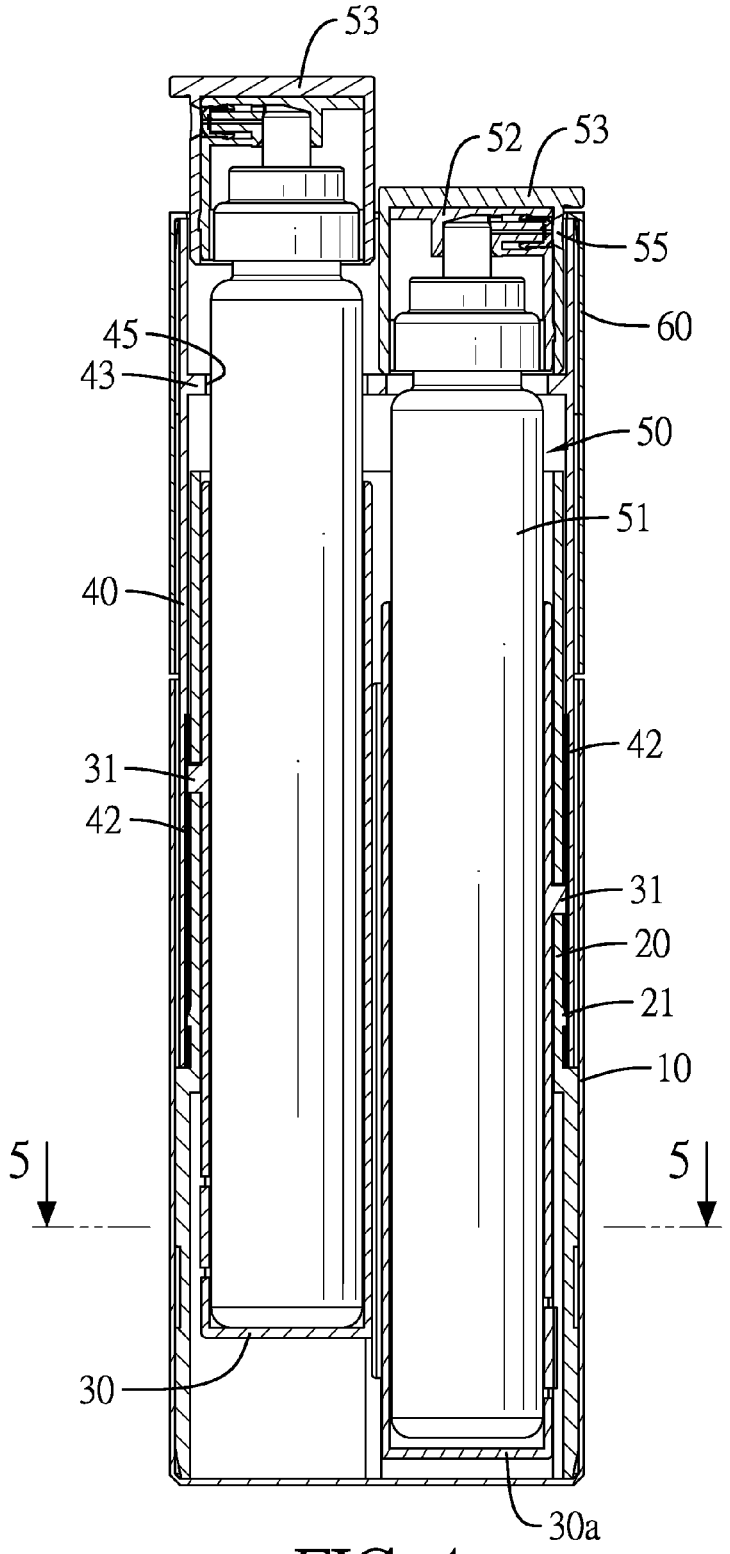
FIG. 4 is a side view in partial section of the composite cosmetic container along line 4-4 in FIG. 3.
Figure 5:
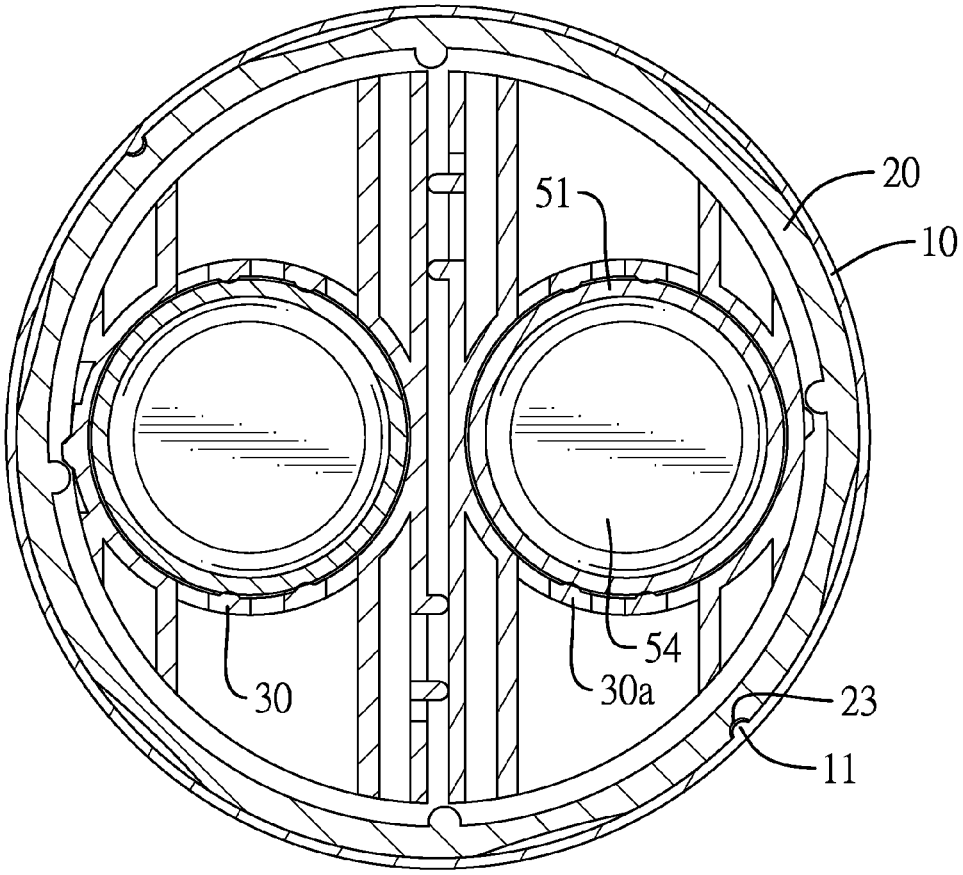
FIG. 5 is an enlarged top view in partial section of the composite cosmetic container along line 5-5 in FIG. 4.
Figure 6:
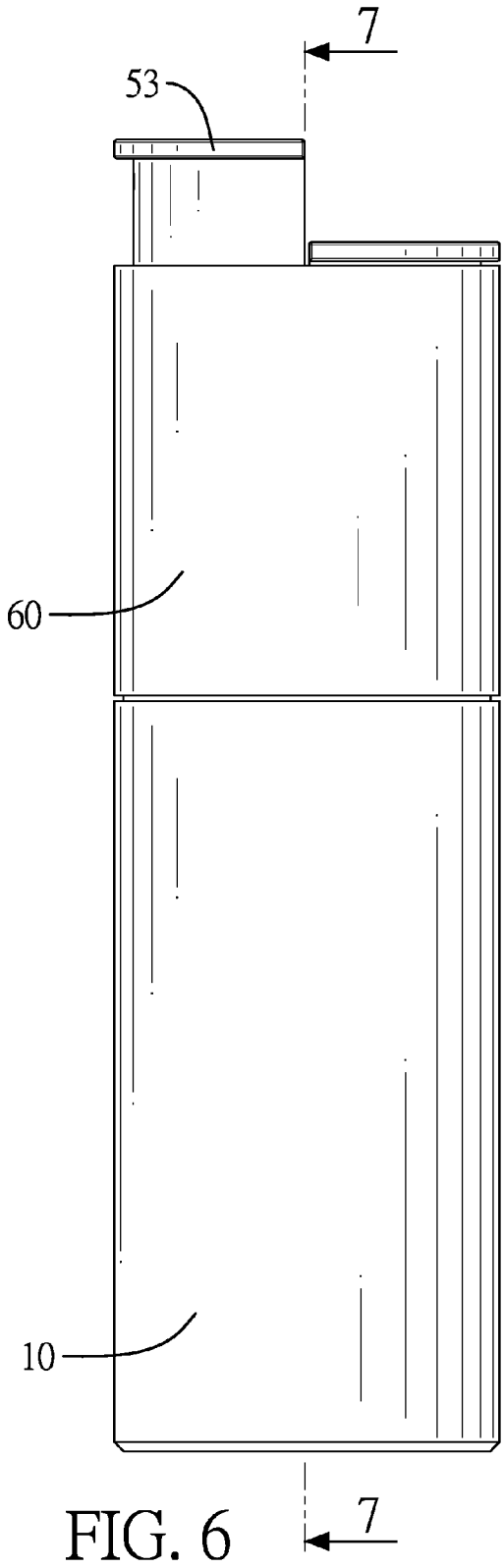
FIG. 6 is a side view of the composite cosmetic container in FIG. 1.

With reference to FIGS. 2 and 4, the vessels 50 are respectively mounted in the seats of the driving assembly 1. The vessels 50 are inserted through the through holes 45 of the second rotating tube 40 respectively and are inserted into the chambers of the seats. Each vessel 50 has a body 51, a chamber 54, a pressing head 52 and a cap 53. With reference to FIG. 5, the body 51 is mounted in a corresponding one of the seats of the driving assembly 1. The chamber 54 is formed in the body 51. With reference to FIG. 4, the pressing head 52 is mounted on the body 51. The cap 53 is mounted on the pressing head 52 and has an outlet 55, and the cap 53 is located above the plate 43. The vessels 50 can be vacuum vessels or press-type vessels. Furthermore, an outer diameter of the body 51 is smaller than a diameter of the through hole 45.

The second sleeve 60 is coactively mounted on the second rotating tube 40 of the driving assembly 1.

With reference to FIG. 2, the multiple chutes of the first rotating tube 20 include a first chute 22 and a second chute 22*a*. The first chute 22 has a slanting section 24, a first transverse section 25, a second transverse section 26 and a first passage 27. The slanting section 24 has a top end and a bottom end. The first transverse section 25 is connected to the top end of the slanting section 24 of the first chute 22. The second transverse section 26 is connected to the bottom end of the slanting section 24 of the first chute 22 and has a distal end. The first passage 27 is connected to the distal end of the second transverse section 26 of the first chute 22 and longitudinally extends to a top end of the first rotating tube 20. The second chute 22*a* has a slanting section 24, a first transverse section 25, a second transverse section 26 and a second passage 28. The slanting section 24 of the second chute 22*a* has a top end and a bottom end. The first transverse section 25 of the second chute 22*a* is connected to the top end of the slanting section 24 of the second chute 22*a* and has a distal end. The second transverse section 26 of the second chute 22*a* is connected to the bottom end of the slanting section 24 of the second chute 22*a*. The second passage 28 is connected to the distal end of the first transverse section 25 of the second chute 22*a* and longitudinally extends to a top end of the first rotating tube 20, and is located at a position diametrically opposite to the first passage 27 of the first chute 22. The multiple seats of the driving assembly 1 include a first seat 30 and a second seat 30*a*. The first seat 30 has the guide element 31 as described, and the guide element 31 of the first seat 30 protrudes through the first chute 22. The second seat 30*a* has the guide element 31 as described, and the guide element 31 of the second seat 30*a* protrudes through the second chute 22*a*.

With reference to FIGS. 1, 2 and 5, the first rotating tube 20 has multiple first grooves 23 formed in the outer surface of the first rotating tube 20. The first sleeve 10 has multiple first ribs 11. The first ribs 11 are formed in an inner surface of the first sleeve 10 and respectively protrude into the first grooves 23 of the first rotating tube 20. With reference to FIG. 2, the second rotating tube 40 has multiple second grooves 44 formed in an outer surface of the second rotating tube 40. The second sleeve 60 has multiple second ribs 61. The second ribs 61 are formed in an inner surface of the second sleeve 60 and respectively protrude into the second grooves 44 of the second rotating tube 40. Furthermore, the first sleeve 10 and the second sleeve 60 are hollow cylinders.

Figure 11:
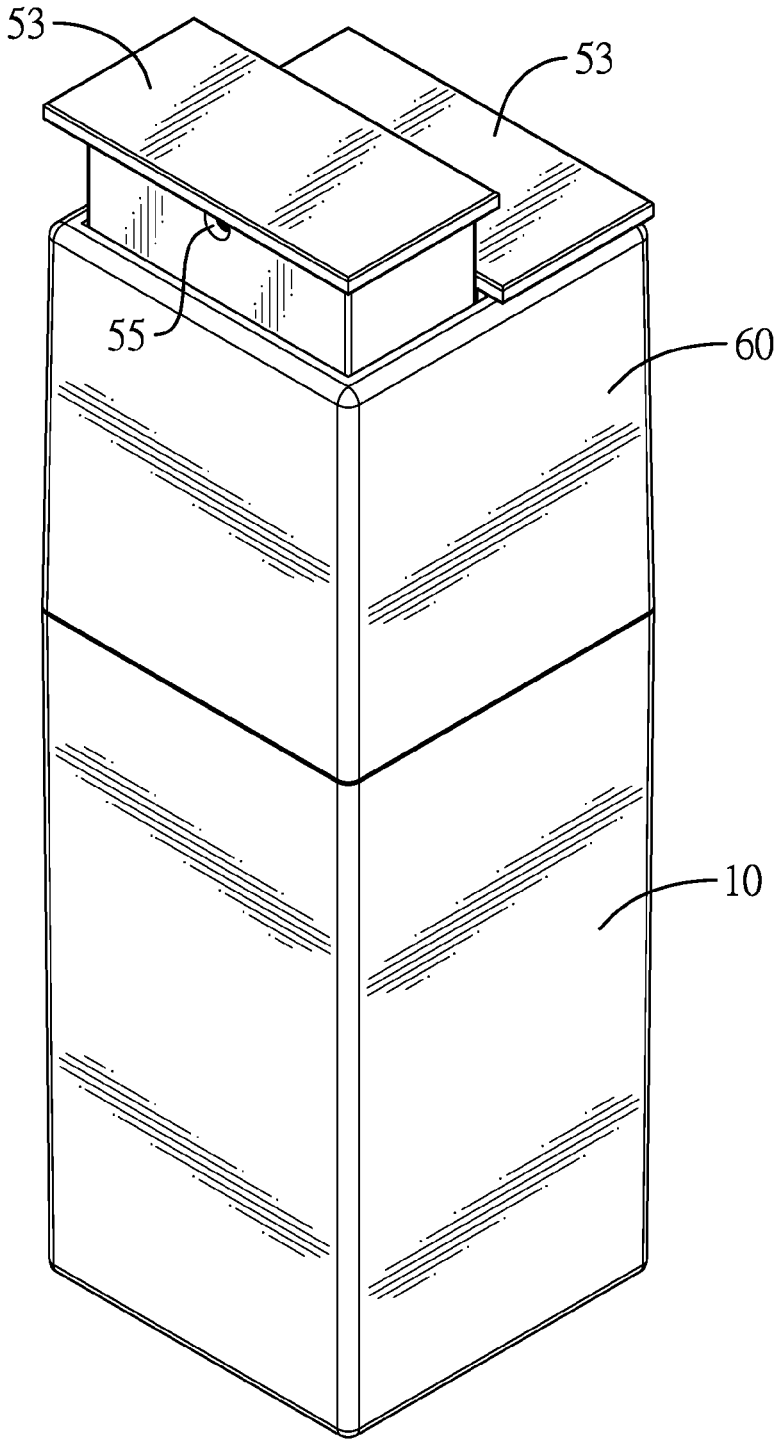
FIG. 11 is a perspective view of a second embodiment of a composite cosmetic container in accordance with the present invention.
Figure 12:
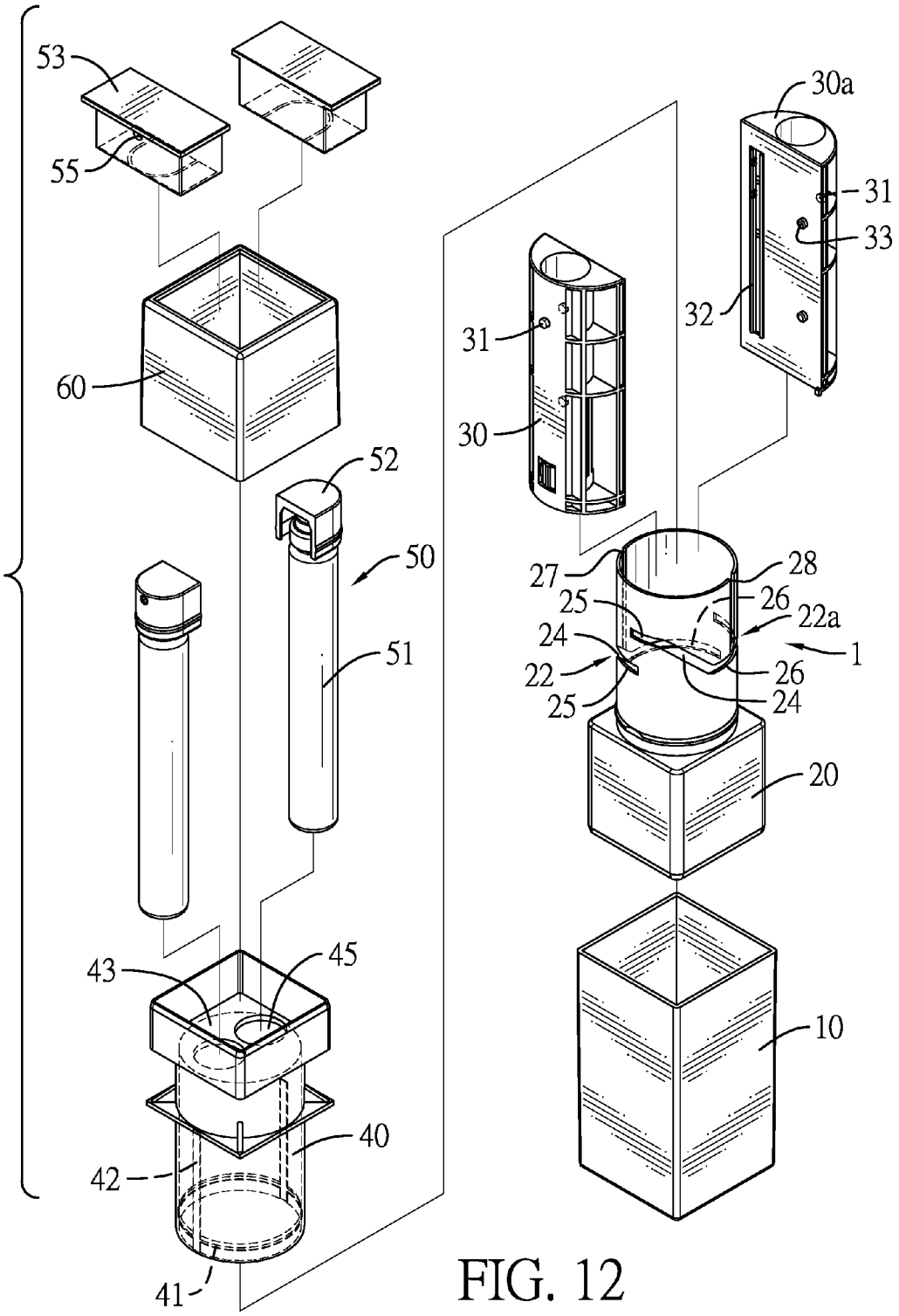
FIG. 12 is an exploded perspective view of the composite cosmetic container in FIG. 11.

With reference to FIGS. 11 and 12, in the second embodiment, the first rotating tube 20 has a first chute 22 and a second chute 22*a*. The first chute 22 has a slanting section 24, a first transverse section 25, a second transverse section 26 and a first passage 27. The slanting section 24 has a top end and a bottom end. The first transverse section 25 is connected to the top end of the slanting section 24 of the first chute 22. The second transverse section 26 is connected to the bottom end of the slanting section 24 of the first chute 22. The first passage 27 is connected to the slanting section 24 of the first chute 22 and longitudinally extends to a top end of the first rotating tube 20. The second chute 22*a* has a slanting section 24, a first transverse section 25, a second transverse section 26 and the second passage 28. The slanting section 24 has a top end and a bottom end. The first transverse section 25 is connected to the top end of the slanting section 24 of the second chute 22*a*. The second transverse section 26 is connected to the bottom end of the slanting section 24 of the second chute 22*a*. The second passage 28 is connected to the second transverse section 26 of the second chute 22*a* and longitudinally extends to a top end of the first rotating tube 20, and is diametrically opposite to the first passage 27 of the first chute 22. In addition, the first sleeve 10 and the second sleeve 60 are hollow rectangular prisms.

Figure 10:
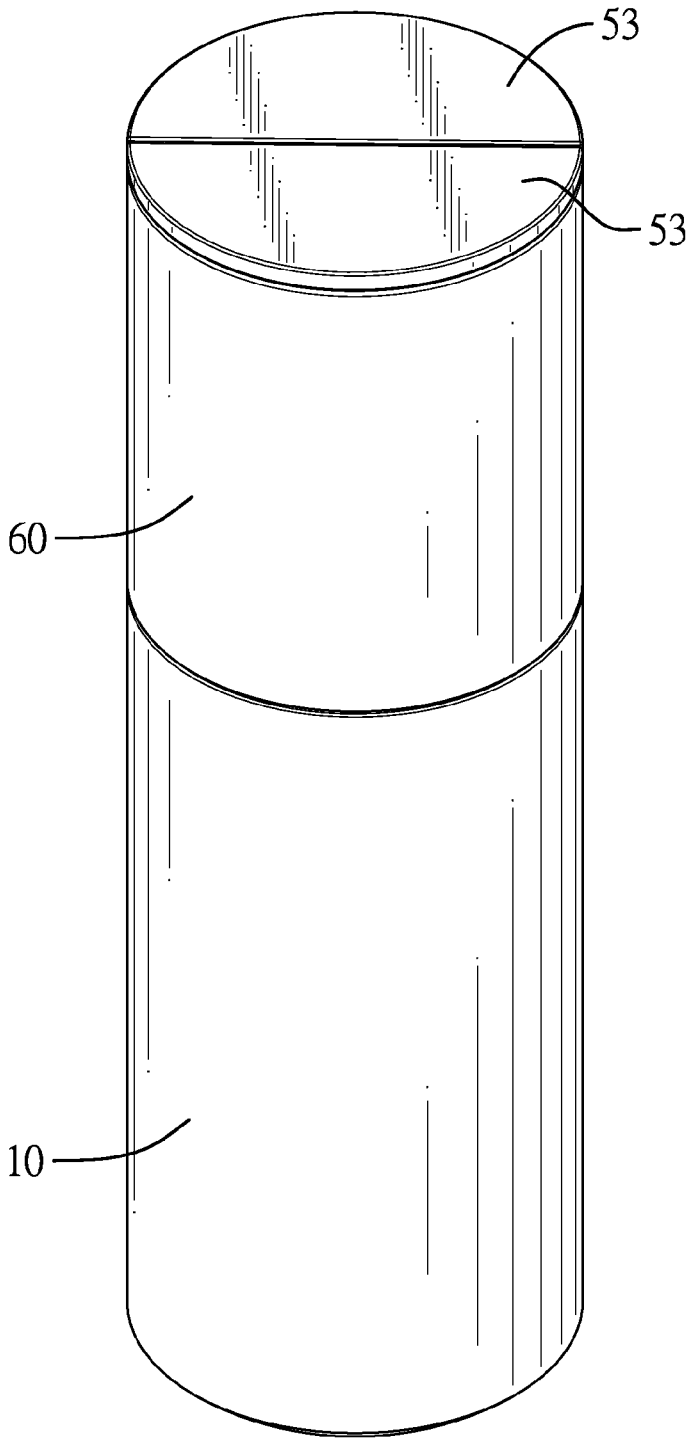
FIG. 10 is a perspective view of the composite cosmetic container in FIG. 1 showing the vessels retracted in a second rotating tube.

With reference to FIG. 10, when multiple cosmetic products respectively stored in the vessels 50 are not yet dispensed, the caps 53 of the vessels 50 are retracted and hidden in the second rotating tube 40, and the outlets 55 of the caps 53 are retracted and hidden in the second rotating tube 40. Moreover, the guide element 31 of the first seat 30 is located in the second transverse section 26 of the first chute 22. The guide element 31 of the second seat 30*a* is located in the second transverse section 26 of the second chute 22*a*.

Figure 3:
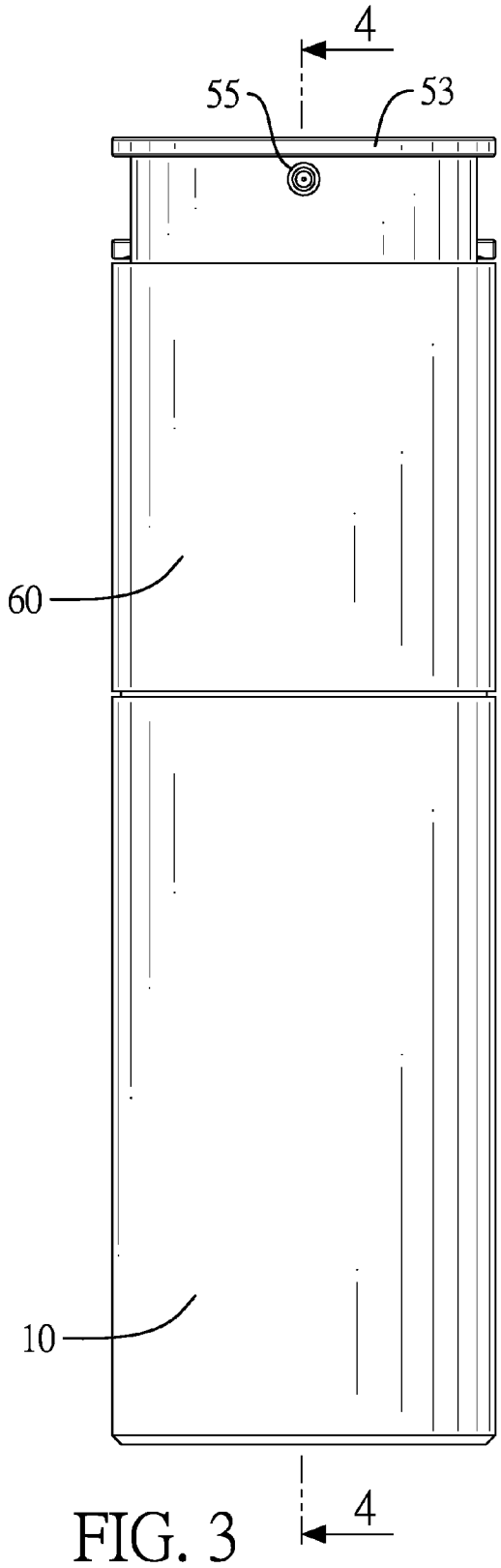
FIG. 3 is a front view of the composite cosmetic container in FIG. 1.
Figure 7:
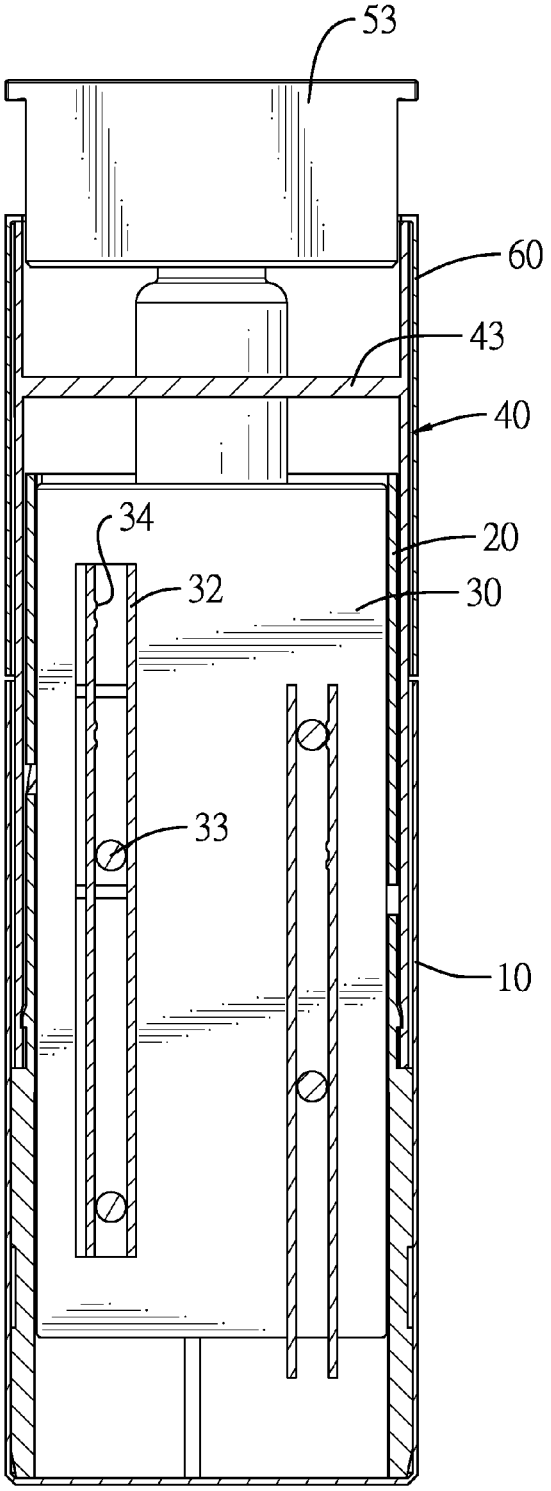
FIG. 7 is a side view in partial section of the composite cosmetic container along line 7-7 in FIG. 6.
Figure 8:
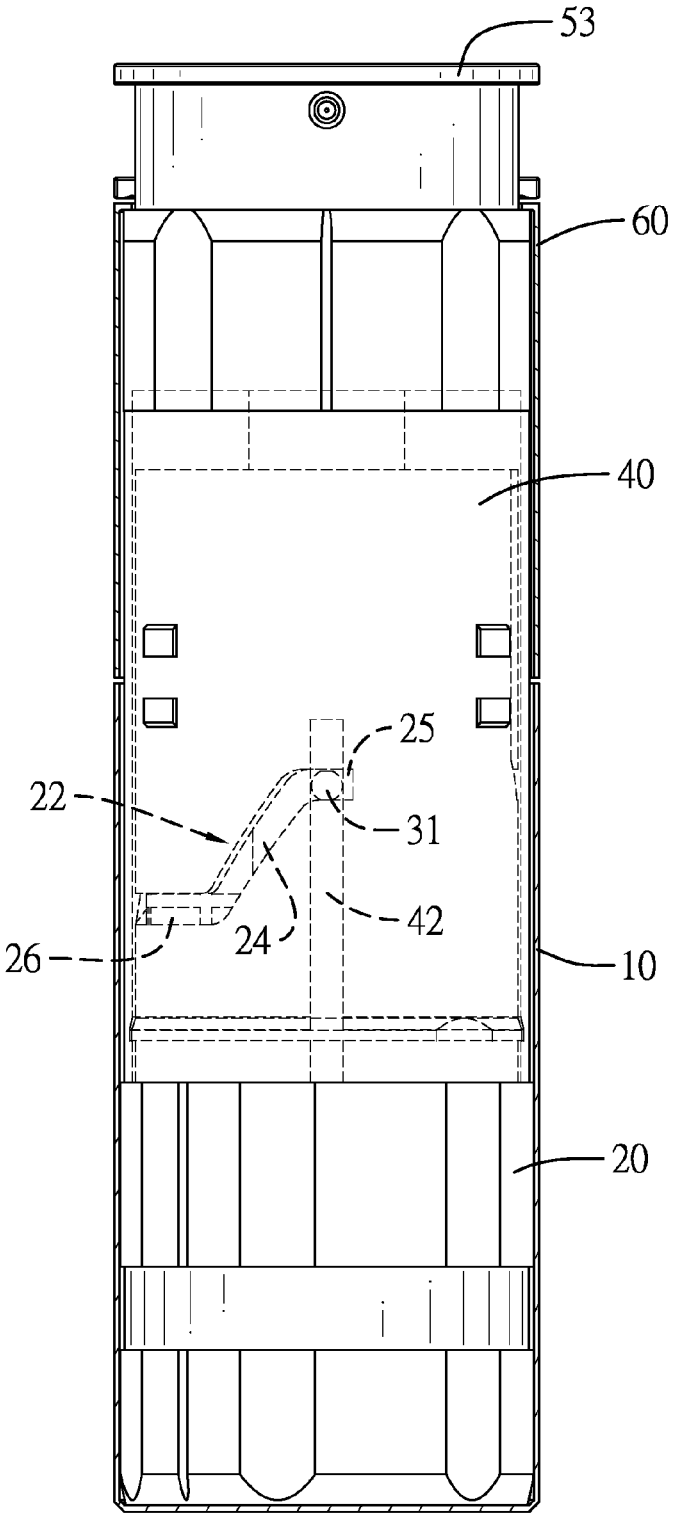
FIG. 8 is a front side view in partial section of the composite cosmetic container in FIG. 1 showing a first seat moved upward.
Figure 9:
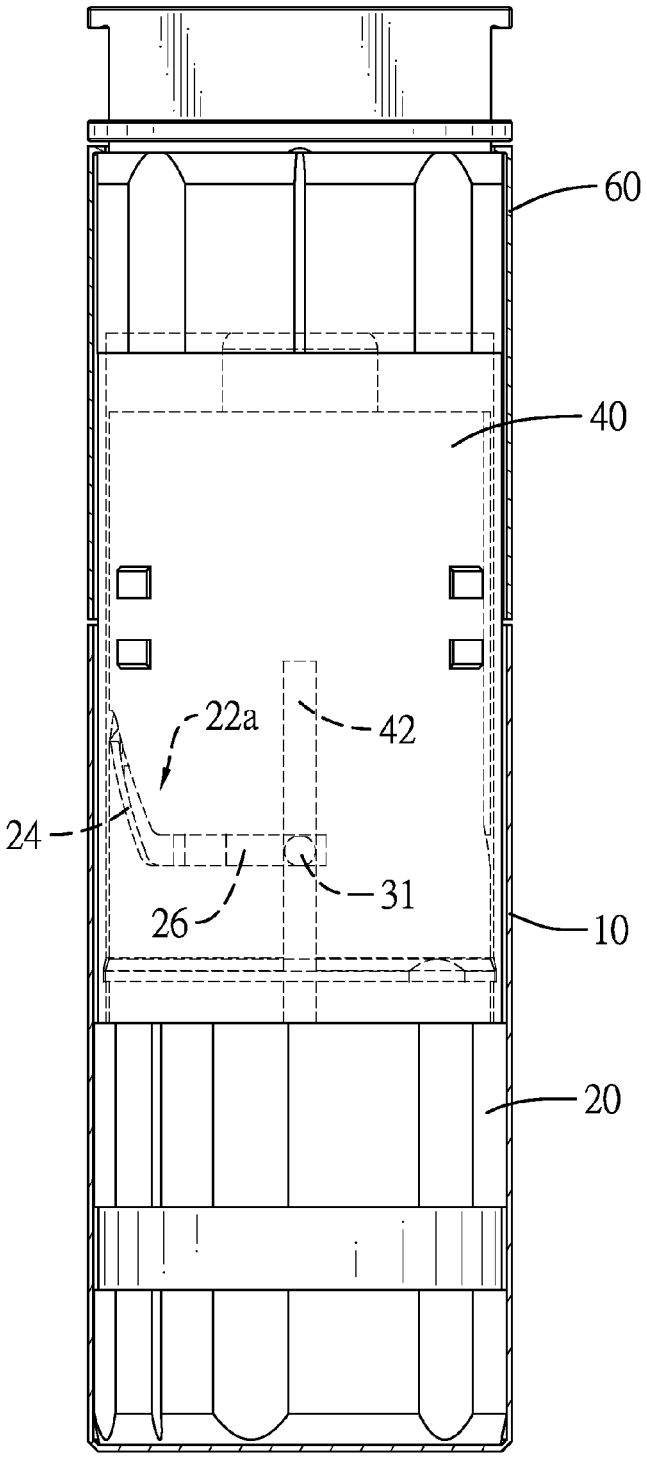
FIG. 9 is a side view in partial section of the composite cosmetic container in FIG. 1 showing a second seat moved downward.

With reference to FIGS. 2 to 4, the first sleeve 10 is rotated in a clockwise rotation to drive the first rotating tube 20 to rotate. With reference to FIG. 8, the guide element 31 of the first seat 30 moves from the second transverse section 26 of the first chute 22 to the first transverse section 25 of the first chute 22. In the meanwhile, the guide element 31 of the first seat 30 moves upward along a corresponding one of the longitudinal grooves 42 of the second rotating tube 40. With reference to FIG. 9, the guide element 31 of the second seat 30*a* moves to the distal end of the second transverse section 26 of the second chute 22*a* simultaneously. During the upward movement of the first seat 30, the guide element 31 of the second seat 30*a* remains moving in the second transverse section 26 of the second chute 22*a*. Therefore, the second seat 30*a* does not move upward or downward. With reference to FIGS. 4 and 7, the outlet 55 of one of the vessels 50 mounted in the first seat 30 is exposed out of the second sleeve 60. The outlet 55 of the vessel 50 mounted in the second seat 30*a* is hidden in the second sleeve 60.

Furthermore, the first sleeve 10 is rotated in an anticlockwise rotation. The guide element 31 of the first seat 30 moves from the first transverse section 25 of the first chute 22 to the slanting section 24 of the first chute 22, and the guide element 31 of the first seat 30 moves downward along a corresponding one of the longitudinal grooves 42 of the second rotating tube 40. The guide element 31 of the first seat 30 keeps on moving to the second transverse section 26 of the first chute 22. At the same time, the guide element 31 of the second seat 30*a* moves from the distal end of the second transverse section 26 of the second chute 22*a* to a bottom end of the slanting section 24 of the second chute 22*a*. The caps 53 of the vessels 50 mounted in the first seat 30 and the second seat 30*a* are retracted into the second rotating tube 40. As the first sleeve 10 keeps rotating in the anticlockwise rotation, the guide element 31 of the first seat 30 moves to the distal end of the second transverse section 26 of the first chute 22. In the meanwhile, the guide element 31 of the second seat 30*a* moves from the bottom end of the slanting section 24 of the second chute 22*a* to the first transverse section 25 of the second chute 22*a*, and the second seat 30*a* moves upward along a corresponding one of the longitudinal grooves 42 of the second rotating tube 40. Therefore, the outlet 55 of the vessel 50 mounted in the second seat 30*a* is exposed out of the second sleeve 60. The outlet 55 of the vessel 50 mounted in the first seat 30 is hidden in the second sleeve 60.

The composite cosmetic container has multiple vessels 50 to contain multiple cosmetic products, such as lotions or perfumes. Users can rotate the first sleeve 10 to select one of the vessels 50 to move upward for conveniently dispensing the cosmetic product contained in the selected vessel 50. In addition, the outer diameter of the body 51 is smaller than the diameter of the through hole 45. Therefore, the vessels 50 are easy to be changed for replacement.

Accordingly, the composite cosmetic container has multiple vessels 50 to contain multiple cosmetic products, so the options of the cosmetic products stored therein are increased. Besides, the composite cosmetic container facilitates easy control of the vessels 50 to selectively move upward or downward by the relative rotation between the first sleeve 10 and the second sleeve 60.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A composite cosmetic container comprising:

a first sleeve;

a driving assembly mounted in the first sleeve and having a first rotating tube coactively mounted in the first sleeve and having an outer surface;

an inner surface;

an annular flange formed around the outer surface of the first rotating tube; and multiple chutes formed through the outer surface of the first rotating tube;

multiple seats moveably mounted in the first rotating tube and each seat having an outer surface facing the inner surface of the first rotating tube;

a connecting surface facing the connecting surface of another seat;

a guide element formed on the outer surface of the seat and protruding into a corresponding one of the chutes of the first rotating tube;

a longitudinal track mounted on the connecting surface of the seat; and multiple protrusions formed on the connecting surface of the seat and protruding into the longitudinal track of another seat; and a second rotating tube rotatably mounted around the first rotating tube and having an inner surface;

an annular groove formed in the inner surface and connected to the annular flange of the first rotating tube;

multiple longitudinal grooves formed in the inner surface of the second rotating tube, and the guide elements of the seats respectively protruding into the longitudinal grooves; and a plate integrally formed in the inner surface of the second rotating tube and located above the longitudinal grooves;

multiple vessels respectively mounted in the seats of the driving assembly and each vessel having a body mounted in a corresponding one of the seats of the driving assembly;

a chamber formed in the body;

a pressing head mounted on the body; and a cap mounted on the pressing head and having an outlet, and the cap located above the plate; and a second sleeve coactively mounted on the second rotating tube of the driving assembly.

2. The composite cosmetic container as claimed in claim 1, wherein the multiple chutes of the first rotating tube include a first chute having a slanting section having a top end and a bottom end;

a first transverse section connected to the top end of the slanting section of the first chute;

a second transverse section connected to the bottom end of the slanting section of the first chute and having a distal end; and a first passage connected to the distal end of the second transverse section of the first chute and longitudinally extending to a top end of the first rotating tube;

a second chute having a slanting section having a top end and a bottom end;

a first transverse section connected to the top end of the slanting section of the second chute and having a distal end;

a second transverse section connected to the bottom end of the slanting section of the second chute; and a second passage connected to the distal end of the first transverse section of the second chute and longitudinally extending to a top end of the first rotating tube, and located at a position diametrically opposite to the first passage of the first chute; and the multiple seats of the driving assembly include a first seat having the guide element, and the guide element of the first seat protruding through the first chute; and a second seat having the guide element, and the guide element of the second seat protruding through the second chute.

3. The composite cosmetic container as claimed in claim 1, wherein the first rotating tube has multiple first grooves formed in the outer surface of the first rotating tube; and the first sleeve has multiple first ribs formed in an inner surface of the first sleeve and respectively protruding into the first grooves of the first rotating tube.

4. The composite cosmetic container as claimed in claim 2, wherein the first rotating tube has multiple first grooves formed in the outer surface of the first rotating tube; and the first sleeve has multiple first ribs formed in an inner surface of the first sleeve and respectively protruding into the first grooves of the first rotating tube.

5. The composite cosmetic container as claimed in claim 1, wherein the second rotating tube has multiple second grooves formed in an outer surface of the second rotating tube; and the second sleeve has multiple second ribs formed in an inner surface of the second sleeve and respectively protruding into the second grooves of the second rotating tube.

6. The composite cosmetic container as claimed in claim 2, wherein the second rotating tube has multiple second grooves formed in an outer surface of the second rotating tube; and the second sleeve has multiple second ribs formed in an inner surface of the second sleeve and respectively protruding into the second grooves of the second rotating tube.

7. The composite cosmetic container as claimed in claim 3, wherein the second rotating tube has multiple second grooves formed in an outer surface of the second rotating tube; and the second sleeve has multiple second ribs formed in an inner surface of the second sleeve and respectively protruding into the second grooves of the second rotating tube.

8. The composite cosmetic container as claimed in claim 4, wherein the second rotating tube has multiple second grooves formed in an outer surface of the second rotating tube; and the second sleeve has multiple second ribs formed in an inner surface of the second sleeve and respectively protruding into the second grooves of the second rotating tube.

9. The composite cosmetic container as claimed in claim 7, wherein the first sleeve and the second sleeve are hollow cylinders.

10. The composite cosmetic container as claimed in claim 8, wherein the first sleeve and the second sleeve are hollow cylinders.

11. The composite cosmetic container as claimed in claim 1, wherein the multiple chutes of the first rotating tube include a first chute having a slanting section having a top end and a bottom end;

a first transverse section connected to the top end of the slanting section of the first chute;

a second transverse section connected to the bottom end of the slanting section of the first chute; and a first passage connected to the slanting section of the first chute and longitudinally extending to a top end of the first rotating tube;

a second chute having a slanting section having a top end and a bottom end;

a first transverse section connected to the top end of the slanting section of the second chute;

a second transverse section connected to the bottom end of the slanting section of the second chute; and a second passage connected to the second transverse section of the second chute and longitudinally extending to a top end of the first rotating tube, and the second passage being diametrically opposite to the first passage of the first chute; and the multiple seats of the driving assembly include a first seat having the guide element, and the guide element of the first seat protruding out the first chute; and a second seat having the guide element, and the guide element of the second seat protruding out the second chute.

12. The composite cosmetic container as claimed in claim 11, wherein the first sleeve and the second sleeve are hollow rectangular prisms.

* * * * *